United States Patent [19]

Hammer et al.

[11] Patent Number: 4,662,403

[45] Date of Patent: May 5, 1987

[54] CASING MATERIAL RESISTANT TO MOLD FUNGUS

[75] Inventors: Klaus-Dieter Hammer, Mainz-Mombach; Manfred Siebrecht, Wiesbaden; Karl-Heinz Wallhäusser, Hofheim; Hermann Winter, Wiesbaden, all of Fed. Rep. of Germany

[73] Assignee: Hoechst Aktiengesellschaft, Frankfurt am Main, Fed. Rep. of Germany

[21] Appl. No.: 636,503

[22] Filed: Aug. 1, 1984

[30] Foreign Application Priority Data

Aug. 11, 1983 [DE] Fed. Rep. of Germany ..... 3328947

[51] Int. Cl.[4] ..... B65B 55/00

[52] U.S. Cl. ..... 138/118.1; 428/36; 426/105; 426/135; 426/532

[58] Field of Search ..... 138/118.1; 426/105, 426/135, 138, 413, 532; 428/36, 907

[56] References Cited

U.S. PATENT DOCUMENTS

| | | | |
|---|---|---|---|
| 2,979,410 | 4/1961 | Parlour | 99/171 |
| 3,617,312 | 11/1971 | Rose | 99/176 |
| 3,818,947 | 6/1974 | Rose | 138/118.1 |
| 4,002,775 | 1/1977 | Kabara | 426/532 |
| 4,253,879 | 3/1981 | Hammer et al. | 106/165 |
| 4,289,171 | 9/1981 | Rassbach | 138/118.1 X |
| 4,356,199 | 10/1982 | Hammer et al. | 138/118.1 X |
| 4,396,039 | 8/1983 | Klenk et al. | 138/118.1 |
| 4,397,337 | 8/1983 | Porrmann et al. | 138/118.1 |
| 4,409,251 | 10/1983 | Higgins | 138/118.1 X |
| 4,529,634 | 7/1985 | Hammer et al. | 138/118.1 X |
| 4,540,613 | 9/1985 | Nicholson | 138/118.1 X |

FOREIGN PATENT DOCUMENTS 3240847 5/1984 Fed. Rep. of Germany .

*Primary Examiner*—James E. Bryant, III

*Attorney, Agent, or Firm*—Schwartz, Jeffery, Schwaab, Mack, Blumenthal & Evans

[57] ABSTRACT

A tubular or web-shaped casing material resistant to mold fungus comprising cellulose and a fungicidal content of glycerol monolaurate. Alkali metal salts of fatty acids and/or alkyl-, aryl- and/or alkyl-aryl-sulfonates are preferably used as the emulsifier. Also disclosed is a process for manufacturing the casing material described above and a fungicidal agent for cellulose casings comprising glycerol monolaurate.

19 Claims, No Drawings

CASING MATERIAL RESISTANT TO MOLD FUNGUS

BACKGROUND OF THE INVENTION

The present invention relates to a casing material based on cellulose which is resistant to mold fungus, to a process for its manufacture and to a fungicidal agent for cellulose sausage casings.

It is known to store foodstuff casings, in particular shirred sausage casings, so-called shirred sticks, of cellulose at a high moisture content before processing. The moisture content is usually more than 20% by weight, relative to the casing, and enables the casings to be processed without prior soaking in water. Disadvantageously, however, the growth of undesired mold fungus and other microorganisms on the cellulose casing is greatly accelerated when the casings are stored under these conditions before processing. The risk of undesired mold formation on the casing surface also still exists even when the casing, filled with a foodstuff as intended, is stored.

Air-cured, long-keeping and uncooked sausages are frequently produced by the natural maturing process. In this process, the sausages, after smoking, are dried in air for a prolonged period of time in order to give them longkeeping qualities. The water vapor escapes outwardly from the sausage meat through the casing wall. If ventilation is poor, undesired mold formation occurs in this case due to the high moisture content on the outside of the casing.

Other types of sausage, such as, for example, types of liver sausage, are frequently packaged in plastic bags. In this case also, undesired mold growth can cause spoiling of the sausage.

To prevent the growth of mold fungus on cellulose casings, ascorbic acid and sorbic acid and their salts have, for example, been described as fungicidal agents, the casing material being impregnated with aqueous solutions of these substances (U.S. Pat. No. 979,410). These known agents are, however, less suitable for casings which must be soaked in water or boiled during processing, since the agents dissolve in water and are thereby quantitatively detached from the casing material. Moreover, there is a risk of the substances exerting an impermissible preserving action on the packaged foodstuff. Also for reasons of foodstuff law, a number of fungicidal compounds are not permitted in packaging material for foodstuffs.

Furthermore, the antimicrobial action of glycerol monolaurate has been known for a long time. According to U.S. Pat. No. 4,002,775, this compound is to be used in medicine, in the preparation of medicaments and cosmetics, and in the preservation of foodstuffs. Even though the problem of mold infestation of sausage casings has been known for a long time and intensive searches for a solution to the problem have been made, as proven by a large number of publications, this compound has so far escaped attention.

SUMMARY OF THE INVENTION

It is therefore an object of the present invention to provide a casing material, based on cellulose, which is suitable as a sausage casing and which exhibits virtually no tendency for infestation by undesired mold fungi and other microorganisms during storage in the moist state.

Another object of the present invention is to provide a casing of the type described above which has a fungicidal agent which is readily accessible, which can be used readily in process engineering terms, which is acceptable under foodstuff law and which has a long-term fungicidal action.

Yet another object of the present invention is to provide a casing material with a fungicidal agent of the type described above which is particularly suitable for sausage casings and which exhibits good adherence to the casing when the sausages are being manufactured, when the casing is soaked in water, scalded or boiled, so that the processed sausage casing retains an adequate quantity of fungicidal agent, when the sausage is stored, and likewise, when the sausage is maturing so that undesirable infestation of the casing with mold fungus does not occur.

In accomplishing the foregoing objects, there has been provided according to one aspect of the present invention a tubular or web-shaped casing material, resistant to mold fungus, comprising cellulose and a fungicidal content of glycerol monolaurate. Preferably, the glycerol monolaurate is present in an amount of at least 50 mg/m$^2$ of surface area of the casing material.

In a preferred embodiment of the invention, there has been provided an emulsifier for said glycerol monolaurate which is preferably selected from alkali metal salts of fatty acids and/or alkyl-, aryl- and/or alkylaryl-sulfonates.

In accordance with another aspect of the present invention, there has been provided a process for the manufacture of a casing material which is resistant to mold fungus, comprising the steps of extruding viscose in the form of a web or tube, coagulating the viscose, regenerating the viscose to produce cellulose hydrate in the gel form, drying the cellulose hydrate gel to produce regenerated cellulose, and applying a homogeneous emulsion of glycerol monolaurate to at least one surface of the web-shaped or tubular cellulose hydrate in the gel form before drying or regenerated cellulose after drying.

In accordance with yet another aspect of the present invention, there has been provided a fungicidal agent for sausage casings based on cellulose, in particular, shirred sausage casings having a moisture content greater than about 20% by weight, relative to the sausage casing, comprising glycerol monolaurate.

Further objects, features and advantages of the present invention will become apparent from the detailed description of preferred embodiments which follows.

DETAILED DESCRIPTION OF PREFERRED EMBODIMENTS

The objects of the present invention are achieved by a casing material which is resistant to mold fungus and which comprises cellulose and a fungicidal content of glycerol monolaurate. The casing can be used as foodstuff packaging, especially as a sausage casing. The casing is produced according to a process in which viscose is extruded in the form of a web or tube, if appropriate on a fibrous body, is coagulated and is regenerated to give cellulose hydrate in the gel form and the latter is then dried to give regenerated cellulose. A homogeneous emulsion of glycerol monolaurate is then applied to at least one surface of the web-shaped or tubular and, if appropriate, fiber-reinforced, cellulose hydrate in the gel form before drying, or regenerated cellulose after drying. The glycerol monolaurate, shown below:

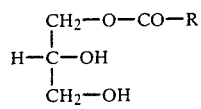

(I)

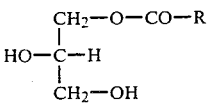

(II)

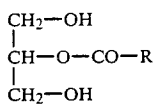

(III)

where R=—$(CH_2)_{10}$—$CH_3$ occurs in the more stable α-form (I) and (II) as racemic (±)-0¹-lauroyl glycerol, and to some extent also in the β-form (III).

Surprisingly, the glycerol monolaurate exhibits an excellent fungicidal action on moist sausage casings based on cellulose. It has not been investigated as to whether one or both optical antipodes (I) and (II) are responsible for the fungicidal action. Probably, specific enzymes of the fungal metabolism are blocked by the glycerol monolaurate. The active ingredient can be applied, without any problems, in an emulsified form to the cellulose material. The glycerol monolaurate exhibits good adherence and is barely detachable by water.

The casing material contains the fungicidal agent preferably on that surface which is remote from the foodstuff to be packaged, that is to say on the outside in the case of tubular casings. The casing material comprises cellulose and is produced by known processes, in particular from viscose.

Viscose is an alkaline solution of sodium cellulose-xanthate and is conventionally produced by reacting alkali cellulose, obtained from cellulose and sodium hydroxide solution, with carbon disulfide in an alkaline medium. After ripening, the viscose is applied to a tubular or web-shaped fibrous body, for example, a paper, or is extruded in the form of a tube or web, without fiber reinforcement. Subsequently, the viscose is spun, i.e., coagulated. The spinning bath includes, for example, sulfuric acid, sodium sulfate and/or ammonium sulfate.

In further stages, the web-shaped or tubular product, which is fiber-reinforced if appropriate, is regenerated in an acid medium to give cellulose hydrate in the gel form, washed with water and treated with a plasticizer. If appropriate, after treatment with an anchoring agent and a film-forming polymer, the cellulose is dried to a water content of about to 5 to 15% by weight, with regenerated cellulose being formed. For the manufacture of tubing from the web-shaped cellulose, a layer of adhesive is required (European patent application No. 0,058,240, the disclosure of which is herein incorporated by reference).

The fungicidal agent is applied in the emulsified form to the coagulated or regenerated, web-shaped or tubular cellulose hydrate gel or, after drying, to the regenerated cellulose. It is advantageous to incorporate a plasticizer for the cellulose, for example, a polyol, such as glycerol, into the emulsion at this time. The application is carried out by means of conventional devices, for example nozzles, rollers, blades or a coating bath.

Glycerol monolaurate can be converted, preferably in the melt, by the addition of emulsifiers into a stable homogeneous emulsion. As has been found, the choice of emulsifier is important here, in order to obtain an optimum fungicidal action. Suitable emulsifiers include the salts of fatty acids, in particular, alkali metal salts of fatty acids having from about b 10 to 20 carbon atoms, such as sodium laurate, sodium stearate, sodium oleate and sodium palmitate, as well as alkali metal salts of alkyl-, aryl- and alkylaryl-sulfonates, in which the alkyl group is preferably unbranched and has from about to 3 to 13 carbon atoms and the aryl group is a benzene system or naphthalene system. By contrast, ethoxylated sorbitan esters and alkyl sulfates, aryl sulfates and alkyl-aryl sulfates reduce the fungicidal action of glycerol monolaurate. The emulsifier is used in a quantity of about to 2 to 12% by weight, preferably about 3 to 10% by weight, relative to glycerol monolaurate.

A good fungicidal action is ensured, if the quantity of glycerol monolaurate on the casing material, in particular on the outer surface of the sausage casing, is at least about 50 mg/m². The quantity applied can be virtually freely selected without an upper limit, but a weight per unit area of about 1000 mg/m² is required only in extreme cases, and values of about 300 mg/m² normally represent the upper limit necessary for fungicidal action. In most cases, the weight of glycerol monolaurate per unit area ranges from about 80 to 200 mg/m².

The quantity of glycerol monolaurate applied can be controlled in the usual way, for example, via the concentration of the emulsion used. The applicable concentration range of glycerol monolaurate depends on the state of the substrate, namely, whether the preparation is carried out with the cellulose hydrate in the gel form, not yet dried, or with a dried regenerated cellulose. If the emulsion is applied to the gel-type cellulose material which has not yet been dried, a concentration between about 1 and 3.5% by weight, preferably between about 1.5 and 2% by weight, of glycerol monolaurate should be chosen. For the dried material (water content less than 15% by weight, relative to the total weight), the concentration range of the glycerol monolaurate should be reduced to about 0.5 to 2.5% by weight, preferably about 0.8 to 1.5% by weight. In the latter case, the cellulose material is dried again, if necessary, after the emulsion has been applied. The quoted values for the glycerol monolaurate relate to the total quantity by weight of the emulsion.

Under the drying conditions, which are conventional, the cellulose surface reaches a temperature of about 80 to 120° C. and the glycerol monolaurate is firmly bonded to the surface. The glycerol monolaurate can be only partially detached even by prolonged boiling in water. After boiling, a sufficient quantity of glycerol monolaurate still remains on the surface of the cellulose to guarantee adequate fungicidal action.

The firm adhesion of the glycerol monolaurate to the cellulose surface results, not only from the low solubility of glycerol monolaurate in water, but principally from the formation of hydrogen bonds between the two free OH groups of the glycerol monoester and the cellulose OH groups. This formation of hydrogen bonds is certainly favored by the transition of the glycerol monolaurate from its β-form (III) to its more stable α-form (I) or (II) at temperatures above its melting point.

After boiling in water for one half an hour, about 80 to 150 mg/m² of glycerol monolaurate of the original about 120 to 180 mg/m² are still found on the surface of the casing material, and after treatment for four hours in hot water at 80° C., about 50 to 110 mg/m² are still present. These quantities are sufficient for preventing growth of mold, for example, in emulsion-type and cooked sausages Emulsion-type sausages are to be understood, for example, as smoked sausage, ham sausage, pork sausage, mortadella, veal sausage or spiced sausage. Cooked sausages include both liver sausage types, which require a gas-impermeable casing, and blood sausage types, which require a smoke-permeable casing.

After inoculating samples of cellulose, treated with glycerol monolaurate, with various mold spores, for example, *Aspergillus niger, Chaetomium globosum, Penicillium chrysogenum* and others, in order to study the fungicidal action of glycerol monolaurate, the germ count falls from $10^6$ to $10^3$ during storage for 14 days at 70 to 75% of relative humidity and 20° C. However, glycerol monolaurate does not have a preserving effect on the foodstuff. surrounded by the casing material, so that this preparation meets Recommendation XXXVI, B VIII of the German Foodstuff Law.

In addition to glycerol monolaurate, it is also possible to use other agents having an antimicrobial spectrum, in particular having a bactericidal and/or fungicidal action, such as, for example, the mixtures or reaction products of a water insoluble resin and salts of organic acids, as known from U.S. Pat. No. 3,617,312 and German Offenlegungsschrift No. 3,240,847.

If the casing material is used as a sausage casing, it can be filled with sausage meat as a tube section or as a shirred stick.

The present invention is now explained in more detail by reference to the non-limiting examples which follow.

EXAMPLE 1

A fiber tube (diameter 58 mm) provided on its outside with viscose is, after passing through a coagulation and precipitation fluid and before entering the dryer, moved for external coating through an impregnation trough which contains a solution of the following composition:

15 g/liter of glycerol monolaurate combined with 0.75 g of sodium laurate as an emulsifier,
100 ml/liter of glycerol, and
900 ml/liter of water.

A solution which contains a conventional agent for improving the adhesion between the casing and sausage meat is filled into the interior of the tube of cellulose hydrate gel.

The tube is then dried in the usual way and moistened to a water content of 8 to 10% by weight.

The quantity of glycerol monolaurate applied to the outer surface is 100 mg/m$^2$, as determined gravimetrically after detachment with methylene chloride. For use as a sausage casing, the tube, which is tied at one end, is filled with sausage meat of the salami type and, the outer surface of the sausages is subsequently inoculated with mold fungi in order to study the fungicidal action of glycerol monolaurate. After a maturing period of 6 weeks, no growth of the undesired mold fungi is detectable.

EXAMPLE 2

A fibrous paper curved to form a tube is provided on the inside and outside with viscose, and the viscose is coagulated and regenerated. The resulting cellulose hydrate tube (diameter 60 mm) is moved in the gelled state before the drier inlet for external coating through a solution of the following composition:

18 g/liter of glycerol monolaurate/emulsifier (Example 1),
100 ml/liter of glycerol, and
900 ml/liter of water.

A solution comprising a conventional adhesion-promoting resin is filled into the interior of the tube. The tube is dried in the inflated state and then coated on its inside with a PVDC dispersion which, after renewed drying, forms a gas-impermeable, closed film.

The quantity of glycerol monolaurate applied to the outer surface is 140 mg/m$^2$.

For use as sausage casings, liver sausage meat is filled into tube sections which are tied at one end. To prove the fungicidal action of glycerol monolaurate, the sausages are inoculated with mold spores, packaged in a polyethylene bag and stored under conventional conditions. After a storage period of 6 weeks, no mold infestation of the sausage casing is detectable.

EXAMPLE 3

A tube, reinforced with a fibrous paper insert of regenerated cellulose having a water content of 8 % by weight, relative to the total weight of the tube (diameter 60 mm) and coated on its inside with a gas-tight, closed film of PVDC, is moved for external coating through a solution of the following composition:

12 g/liter of glycerol monolaurate/emulsifier (Example 1),
100 ml/liter of glycerol, and
900 ml/liter of water.

The tube is then dried. The quantity of glycerol monolaurate applied is 180 mg/m$^2$.

Emulsion-type sausage meat is filled into the tube casing sections which are tied at one end. To prove the fungicidal action of glycercol monolaurate, the sausages are inoculated with mold spores and stored under conventional conditions. No growth of mold occurs.

EXAMPLE 4

Before drying, the cellulose hydrate tube in the gel state of Example 2 is moved through an impregnation trough which contains the following solution:

120 ml of a 20% solution of an epichlorohydrin/polyamine-polyamide resin (Resamin HW 601, a product from Messrs. Cassella),
15 g of potassium sorbate, 100 ml of glycerol, and
713.5 ml of water.

This solution is then mixed, by vigorous stirring, with 66.5 ml of an emulsion which comprises 15 g of glycerol monolaurate/emulsifier (Example 1).

A solution which includes a conventional agent for improving the adhesion between the casing and sausage meat is filled into the interior of the tube. The tube is then dried in the inflated state, subsequently sprayed with water to a moisture content of 24 to and shirred into shirred sticks. Upon drying, the epichlorohydrin/-polyaminepolyamide resin is cured and passes into its water-insoluble form. The moist sticks are tightly packed into water vapor-tight film bags and stored for about one month. No infestation with mold fungi is observed.

Sausage meat of the superior salami type is then filled into these casings. The finished sausages are inoculated with mold spores, in order to prove the fungicidal action of glycerol monolaurate, and are stored under conventional conditions. Even after a storage period of 6 weeks, no growth of undesired mold fungi is observed.

The casing material of the present invention has the advantage that the fungicidal action is preserved over long periods, even if the material comes into intense contact with water. By contrast, no preserving action of the fungicidal agent on the foodstuff packaged by means of the casing material is detectable. Likewise, an adverse influence of the fungicidal agent on the physical properties of the casing material is not detectable. Moreover, a possible absorption by humans of the fungicidal agent together with the foodstuff is not a concern.

In addition, glycerol monolaurate is a readily accessible compound and can be obtained commercially. It can be applied to the casing material by simple process measures.

The fungicidal agent is of particular interest for use with sausage casings which have a layer impermeable to water vapor and gas and which are envisaged for sausages of the emulsion sausage type and cooked sausage type, with sausage casings for sausages which are smoked, and with sausage casings which, before processing, are stored in the moist state (water content above 20% by weight).

What is claimed is:

1. A tubular or web-shaped casing material, resistant to mold fungus, comprising premoistened cellulose containing an effective amount of glycerol monolaurate by weight of the casing to be a fungicide and an emulsifier for said glycerol/monulaurate.

2. A tubular or web-shaped casing according to claim 1, wherein said emulsifier is selected from alkali metal salts of fatty acids and/or alkyl-, aryl- and/or alkylaryl sulfonates.

3. A tubular or web-shaped casing according to claim 1, wherein said emulsifier is present in a quantity from about 2 to 12% by weight, relative to the glycerol monolaurate.

4. A tubular or web-shaped casing according to claim 3, in said emulsifier is present in a quantity from about 3 to 10% by weight, relative to the glycerol monolaurate.

5. A tubular or web-shaped casing according to claim 1, wherein said cellulose is selected from regenerated cellulose or fiber-reinforced regenerated cellulose.

6. A tubular or web-shaped casing according to claim 1, further comprising a water vapor-impermeable layer on at least one surface of said casing material.

7. A tubular or web-shaped casing according to claim 6, wherein said glycerol monolaurate is applied to the outer surface of the tubular casing.

8. A tubular or web-shaped casing according to claim 7, further comprising a water vapor-impermeable layer on the inside of said casing material.

9. A tubular or web-shaped casing according to claim 1, wherein the casing has a water content of more than about 20% by weight, relative to the casing.

10. A tubular or web-shaped casing according to claim 1, wherein the casing material comprises at least about 50 mg/m$^2$ of said glycerol monolaurate.

11. A tubular or web-shaped casing material according to claim 10, wherein said glycerol monolaurate is present in an amount of from about 50 to 1000 mg/m$^2$.

12. A tubular or web-shaped casing material according to claim 11, wherein said glycerol monolaurate is present in a amount of from about 50 to 300 mg/m$^2$ of surface area of the casing material.

13. A tubular or web-shaped casing material according to claim 12, wherein said glycerol monolaurate is present in an amount of from about 80 to 200 mg/m$^2$ of surface area of the casing material.

14. A tubular or web-shaped casing material according to claim 1, which further comprises an epichlorohydrin/polyamine-polyamide resin.

15. A tubular or web-shaped casing material according to claim 1, comprising a tubular sausage casing.

16. A tubular or web-shaped Ser. No. 636,503 casing material according to claim 15, wherein the casing is shirred.

17. A tubular or web-shaped casing material according to claim 16, wherein said casing is a boilable sausage casing.

18. A tubular or web-shaped casing material according to claim 15, which has been boiled in water for at least one half hour.

19. A sausage casing, comprising a tubular or web-shaped casing material, wherein said casing material:

comprises regenerated cellulose or fiber-reinforced cellulose;

has a water content of more than 20% by weight, relative to the casing;

contains a fungicidal content of glycerol monolaurate, in an amount of at least 50 mg/m$^2$, based on the casing;

contains an epichlorohydrin/polyamine-polyamide resin; and contains an emulsifier, comprising either an alkali salt of a fatty acid or an alkyl-, aryl-, or alkylaryl sulfonate.

* * * * *